US011346168B2

(12) United States Patent
Bertoja

(10) Patent No.: US 11,346,168 B2
(45) Date of Patent: May 31, 2022

(54) SELF-PROPELLING PERFORATING GUN SYSTEM

(71) Applicant: Schlumberger Technology Corporation, Sugar Land, TX (US)

(72) Inventor: Michael Bertoja, Clamart (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/721,968

(22) Filed: Dec. 20, 2019

(65) Prior Publication Data

US 2020/0199957 A1 Jun. 25, 2020

Related U.S. Application Data

(60) Provisional application No. 62/782,677, filed on Dec. 20, 2018.

(51) Int. Cl.
*E21B 43/119* (2006.01)
*E21B 23/00* (2006.01)
*E21B 43/116* (2006.01)

(52) U.S. Cl.
CPC ..... *E21B 23/00* (2013.01); *E21B 43/116* (2013.01); *E21B 43/119* (2013.01); *E21B 23/001* (2020.05)

(58) Field of Classification Search
CPC ..... E21B 43/119
See application file for complete search history.

(56) References Cited

U.S. PATENT DOCUMENTS

| | | | | |
|---|---|---|---|---|
| 2,955,533 | A * | 10/1960 | Martinez, Jr. | E21B 43/117 102/318 |
| 3,442,083 | A * | 5/1969 | Klotz | F02K 9/80 60/229 |
| 9,033,041 | B2 | 5/2015 | Baihly et al. | |
| 9,441,470 | B2 | 9/2016 | Guerrero et al. | |
| 9,695,677 | B2 | 7/2017 | Moody-Stuart et al. | |
| 2014/0054031 | A1* | 2/2014 | Heijnen | E21B 33/1208 166/250.17 |
| 2016/0024902 | A1* | 1/2016 | Richter | E21B 43/116 166/250.01 |
| 2019/0284889 | A1* | 9/2019 | Lagrange | E21B 47/092 |

* cited by examiner

*Primary Examiner* — Giovanna Wright
(74) *Attorney, Agent, or Firm* — Rodney Warfford

(57) ABSTRACT

A well system includes a perforating gun having shaped charges and a detonator to controllably detonate the shaped charges. The well system further includes a propulsion head coupled to the perforating gun. The propulsion head is operable to apply thrust to the perforating gun such that the well system is self-propelling.

18 Claims, 8 Drawing Sheets

SELF-PROPELLING PERFORATING GUN SYSTEM

CROSS-REFERENCE TO RELATED APPLICATIONS

The present application claims priority to U.S. Provisional Patent Application Ser. No. 62/782,677 filed 20 Dec. 2018, which is herein incorporated by reference.

BACKGROUND

Field

The disclosure relates to the field of hydrocarbon well perforation. More specifically, apparatus and methods of perforating gun conveyance.

Description of the Related Art

When a hydrocarbon well is drilled, a casing may be placed in the well to line and seal the wellbore. Cement is then pumped down the well under pressure and forced up the outside of the casing until the well column is also sealed. This casing process: (a) ensures that the well is isolated, (b) prevents uncontrolled migration of subsurface fluids between different well zones, and (c) provides a conduit for installing production tubing in the well. However, to connect the inside of the casing and wellbore with the inside of the formation to allow for hydrocarbon flow from the formation to the inside of the casing, holes or tunnels must be formed through the casing and into the wellbore. This practice is commonly referred to as perforation of the casing and formation. In applications where a casing is not used (i.e. open-hole applications), jetting, fracturing or perforating is applied directly to the formation.

During the perforating process, a gun-assembled body containing a plurality of shaped charges is lowered into the wellbore and positioned opposite the subsurface formation to be perforated. Initiation signals are then passed from a surface location through a wireline to one or more blasting caps located in the gun body, thereby causing detonation of the blasting caps. The exploding blasting caps in turn transfer a detonating wave to a detonator cord which further causes the shaped charges to detonate. The detonated shaped charges form an energetic stream of high-pressure gases and high velocity particles, which perforates the well casing and the adjacent formation to form perforation tunnels. The hydrocarbons and/or other fluids trapped in the formation flow into the tunnels, into the casing through the orifices cut in the casing, and up the casing to the surface for recovery.

In markets such as the North America shale market, it is common for horizontal wells to be completed in multi-stages using known methods of pump down perforation. To facilitate the pump down perforation method, the end of the horizontal well must be perforated to initiate the ability to pump fluid into the well and deploy subsequent wireline perforating guns. The perforation of the end of the well is typically done through pressure activated sleeves or by deploying perforating guns on tubing such as coiled tubing or by use of a tractor to push the perforating guns along the horizontal section of the well.

Irrespective of a vertical, horizontal, or deviated wellbore, conveyance of the perforating guns always requires additional conveyance equipment adding to the cost, time, and complexity of the operation. What is needed is an improved method and apparatus for perforating gun conveyance.

SUMMARY

This summary is provided to introduce a selection of concepts that are further described below in the detailed description. However, many modifications are possible without materially departing from the teachings of this disclosure. Accordingly, such modifications are intended to be included within the scope of this disclosure as defined in the claims. This summary is not intended to identify key or essential features of the claimed subject matter, nor is it intended to be used as an aid in limiting the scope of the claimed subject matter.

An embodiment of the present disclosure provides a perforating gun system for deployment in a wellbore, the wellbore having a bottom end. The perforating gun system comprises a perforating gun carrying shaped charges and a detonator actuatable to controllably detonate the shaped charges. The perforating gun system further comprises a propulsion head coupled to the perforating gun, wherein the propulsion head is operable to apply thrust to the perforating gun. The perforating gun system is self-propelling.

Another embodiment of the present disclosure provides a method of perforating. The method comprises the steps of: (a) propelling a perforating gun comprising shaped charges and a detonator through a wellbore by activation of a propulsion head coupled to the perforating gun; (b) detecting a target location in the wellbore; and (c) in response to detecting the target location in the wellbore, actuating the detonator to detonate the plurality of shaped charges.

BRIEF DESCRIPTION OF THE DRAWINGS

Certain embodiments of the disclosure will hereafter be described with reference to the accompanying drawings, wherein like reference numerals denote like elements. It is emphasized that, in accordance with standard practice in the industry, various features are not drawn to scale. In fact, the dimensions of various features may be arbitrarily increased or reduced for clarity of discussion. It should be understood, however, that the accompanying figures illustrate the various implementations described herein and are not meant to limit the scope of various technologies described herein, and.

DETAILED DESCRIPTION

Figure 1:
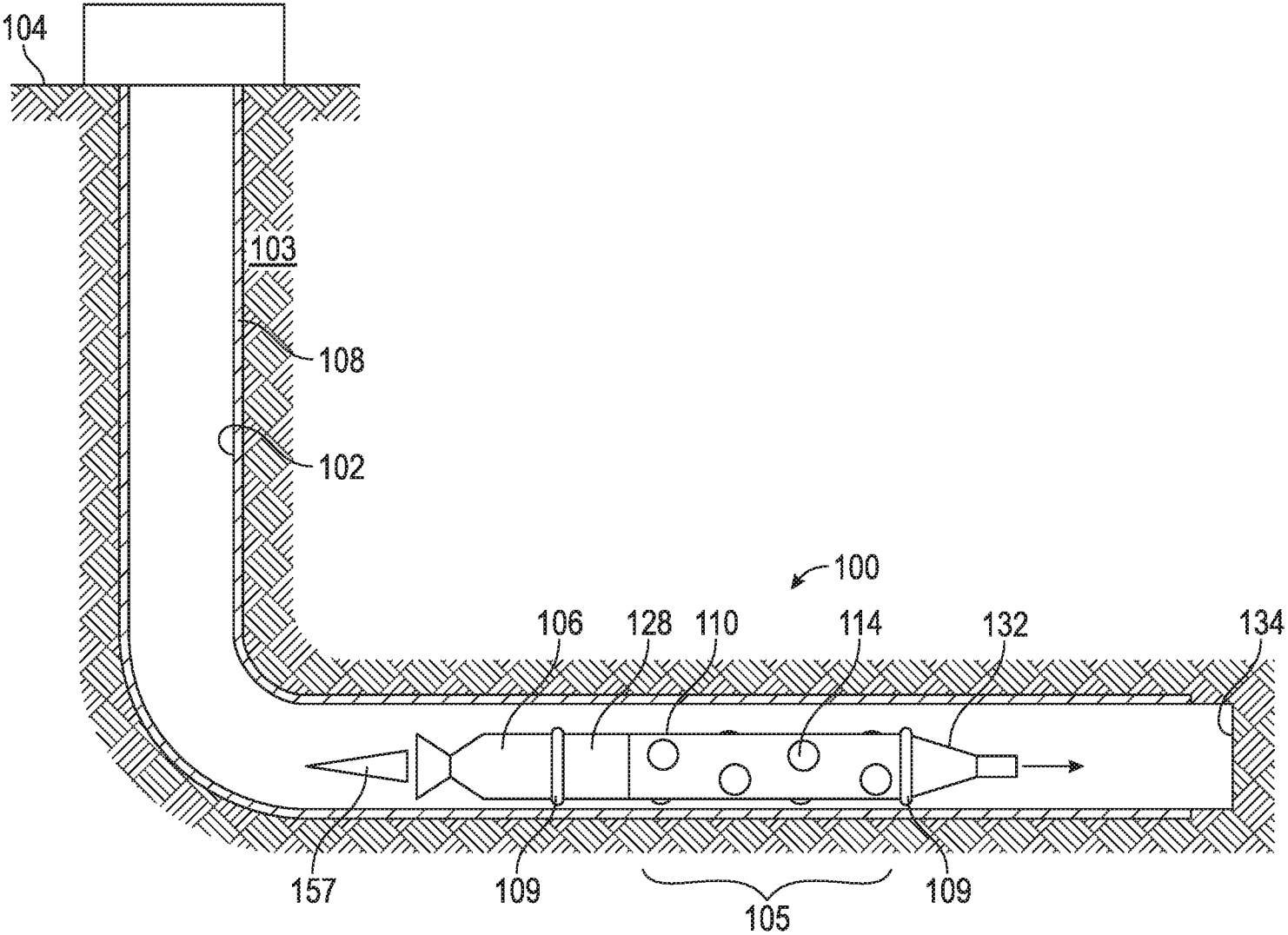
FIG. 1 is a schematic illustration of a perforating gun system being self-propelled through a wellbore, according to one embodiment of the present disclosure.

The foregoing general description and the following detailed description are exemplary of the invention and are intended to provide an overview or framework for understanding the nature of the invention as it is claimed. The accompanying drawings are included to provide further understanding of the invention and are incorporated in and constitute a part of this specification. The drawings illustrate various embodiments of the invention and together with the description serve to explain the principles and operation of the invention.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for purposes of simplicity and clarity and does not in itself dictate a relationship between the various embodiments and/or configurations discussed. However, it will be understood by those of ordinary skill in the art that the system and/or methodology may be practiced without these details and that numerous variations or modifications from the described embodiments are possible. This description is not to be taken in a limiting sense, but rather made merely for purposes of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements.

In this disclosure, unless the context requires otherwise, throughout the specification and claims which follow, the word "comprise" and variations thereof, such as, "comprises" and "comprising" are to be construed in an open, inclusive sense, that is as "including, but not limited to."

In this disclosure, reference to "one implementation" or "an implementation" or to "one embodiment" or "an embodiment" means that a particular feature, structures, or characteristics may be combined in any suitable manner in one or more implementations or one or more embodiments.

In this disclosure, the singular forms "a," "an," and "the" include plural referents unless the content clearly dictates otherwise. It should also be noted that the term "or" is generally employed in its broadest sense, that is, as meaning "and/or" unless the content clearly dictates otherwise.

The headings and Abstract of the disclosure provided herein are for convenience only and do not interpret the scope or meaning of the embodiments.

FIG. 1 is a schematic illustration of an embodiment of the perforating gun system 100 of the present disclosure. As shown, the perforating gun system 100 is traversing a wellbore 102 drilled through formation(s) 103. The perforating gun system 100 is designed as a self-propelled system, which means that the system is moving or able to move without the aid of external propulsion or external conveyance, such as wireline, coiled tubing, a tractor, or the like.

The perforating gun system 100 may be deployed into the wellbore 102 from a surface location 104 by initiation of the propulsion system. Depending on the application and the orientation of the well, the perforating gun system 100 may be deployed by releasing the self-propelled perforating gun system 100 directly into the wellbore 102 from the surface. In some embodiments, the perforating gun system 100 may be initially deployed via a conveyance tool (not shown) to a target location such as a horizontal section of the wellbore or to a target branch in a multilateral wellbore. Once in the target location, the perforating gun system 100 is released from the conveyance tool and further travel of the perforating gun system 100 is enabled through initiation of its propulsion system.

In one embodiment of the present disclosure, the perforating gun system 100 includes a perforating gun 105 carrying shaped charges 114 and a propulsion head 106 coupled to the perforating gun 105. The term "propulsion head," as used herein, means a device or system that can push an attached load forward. The propulsion head 106 may be, for example, a propulsion motor, such as a rocket motor, a hydraulic propulsion system, an electric propulsion system, a magnetic propulsion system, or a motor driven propeller that is powered electrically, magnetically or energetically.

Figure 3:
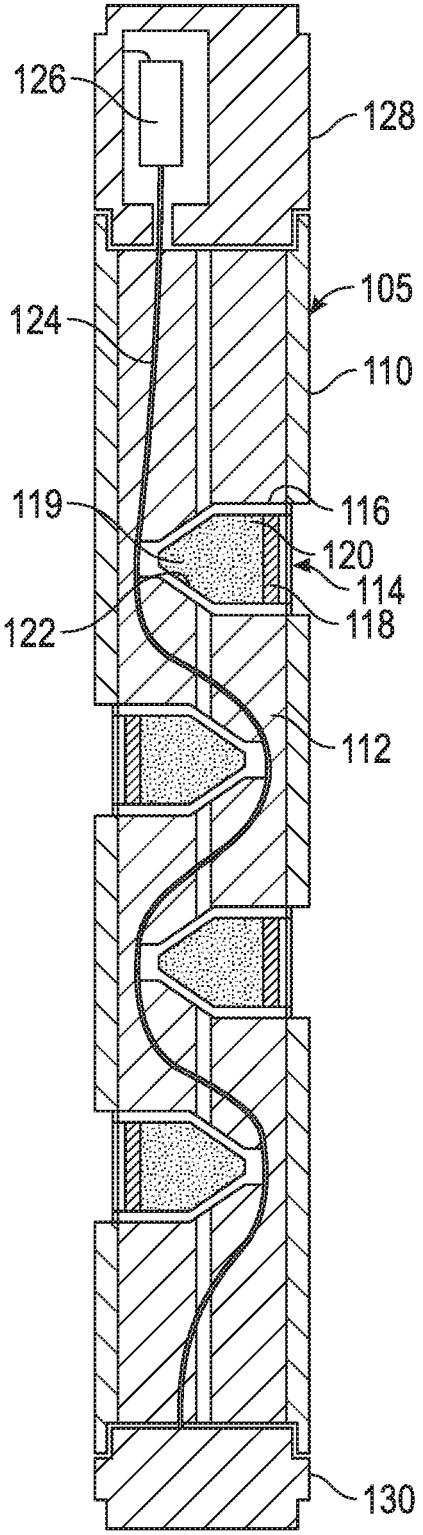
FIG. 3 is a cross-section of a perforating gun, according to one embodiment of the present disclosure.

By coupling the propulsion head 106 to the perforating gun 105, the perforating gun system 100 is able to move as a unit through sections of the wellbore 102, whether horizontal, deviated, or vertical, without any other external force. The term "external," as used herein with "force", means outside of or separate from the perforating gun system 100. In some embodiments, as will be described herein, the perforation gun system 100 may include a capability to detect a target location in the wellbore 102. The propulsion head 106 may propel the perforating gun system 100 to the target location, at which point the detonator (as illustrated in FIG. 3) 126 located within the firing head 128 is actuated and the shaped charges 114 of the perforating gun 105 are fired to perforate the casing (or other tubing) 108 lining the wellbore 102, or a wall of the wellbore 102 in open hole applications.

In other embodiments of the present disclosure, the propulsion head 106 may propel the perforating gun system 100 until the nose 132 of the perforating gun system 100 strikes the end or bottom 134 of the wellbore 102. In such embodiments, the impact of the nose 132 with the end 134 of the wellbore 102 generates an impact energy that is transferred to the detonator 126 within the firing head 128 for actuation. For instance, the detonator 126 may include a percussion detonator that activates upon impact and transfers the impact energy to the detonation cord 124. It should be understood, that any known methods of transferring the impact energy may be used and remain within the purview of the present disclosure.

Figure 2:
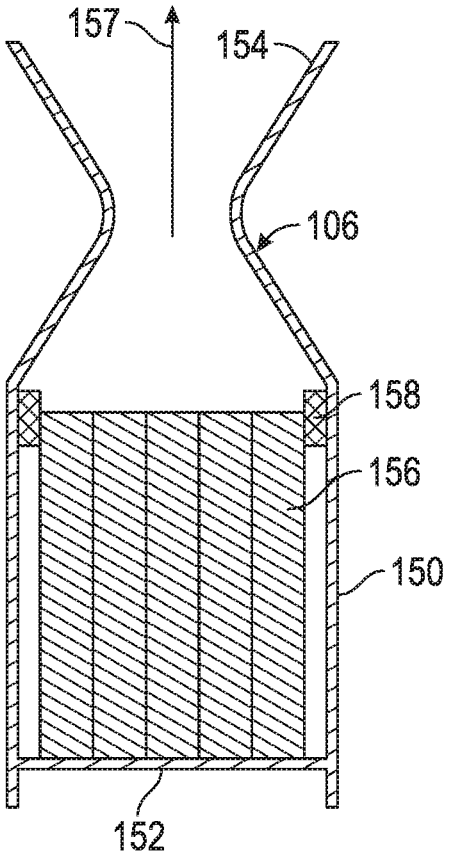
FIG. 2 is a cross-section of a propulsion head, according to one embodiment of the present disclosure.

FIG. 2 shows an example embodiment of a propulsion head 106 of the present disclosure wherein the propulsion head 106 is a type of rocket motor. As shown, the propulsion head 106 includes a shell 150 that is closed at one end 152 and open at the opposing end through a propulsion nozzle 154. The propulsion head 106 is attached or affixed to the perforating gun system 100 approximate its closed end 152. As should be understood, the propulsion head 106 may be attached or affixed by means known in the art such as threaded connections, or may be attached or affixed through the use of adapters, or may be integrated into the body of the perforating gun system 100. All such alternate embodiments fall within the purview of the present disclosure.

The shell 150 of the propulsion head 106 may be charged with a gas generating material, e.g., propellant 156. In an embodiment of the present disclosure, an electrode 158 in electrical communication with the propellant 156 applies electrical current to the propellant 156 when the propulsion head 106 is activated. The propulsion head 106 may include a control circuit (not shown) to determine when the electrical current is applied to the propellant 156 through the electrode 158.

In general, any suitable arrangement of propellant(s) and any suitable method of applying current to the propellant(s) in order to burn the propellant(s) may be used. The propellant 156 burns in response to the applied current, generating gases in the process. The gases expand through the nozzle 154, resulting in a thrust 157 that illustrated in FIG. 2 as an arrow. The thrust 157 propels the propulsion head 106 and a load (i.e. the perforating gun 105) that is attached to the propulsion head 106. The direction of the thrust 157 is opposite to the direction of the expanding gases.

In one example embodiment of the present disclosure, the amount of propellant 156 may be selected such that the propellant is exhausted approximate the time that the perforating gun system 100 is at the target location within the wellbore 102. In other embodiments, the amount of propellant is selected to ensure that the perforating gun system 100 reaches the bottom (or end) 134 of the wellbore 102. In such embodiments, the impact of the perforating gun system 100 with the bottom 134 of the wellbore 102 acts as the stop for the perforating gun system.

Returning to FIG. 1, the travel of the perforating gun system 100 through the wellbore 102 may be guided by the trajectory of the wellbore 102. In some embodiments of the present disclosure, low friction devices, such as rollers or low friction pad materials, may be provided on the external surface of the perforating gun system 100, such as on the collars 109 to improve the efficiency of travel for the perforating gun system 100.

The perforating gun 105 used in embodiments of the perforating gun system 100 of the present disclosure may employ any perforating gun design known in the art. For illustrative purposes, FIG. 3 shows an example structure of the perforating gun 105. In FIG. 3, the perforating gun 104 includes a gun carrier 110. A loading tube 112 inside the carrier 110 has a plurality of shaped charges 114 mounted within. Each shaped charged 114 may be an encapsulated shaped charge 114 including a charge casing 116, a sealing cap 118 that cooperates with the charge casing 116 to provide a sealed chamber 119, and an explosive material 120 disposed within the sealed chamber 119. The shape, material, and position of the liner 122 inside the charge casing 116 are designed to direct the energy of the explosive material 120 upon detonation in a desired direction to form perforations into a target formation.

A detonation cord 124 may be routed through the loading tube 112 and is in communication with the plurality of shaped charges 114. A firing head 128 may be attached to one end of the gun carrier 110. The firing head 128 includes a detonator 126 that when activated at a determined time and location initiates detonation of the detonation cord 124. The detonation cord 124 in turn initiates detonation of the shaped charges 114. The firing head 128 may be coupled to the propulsion head 106 as shown in FIG. 1.

As shown in FIG. 3, a connector cap 130 may be attached to the end of the gun carrier 110 opposite the firing head 128. The connector cap 130 may include features to couple the perforating gun 105 to the nose 132, may act as an adapter, or may be coupled to an adapter for purposes of connecting additional perforating guns.

Figure 4:
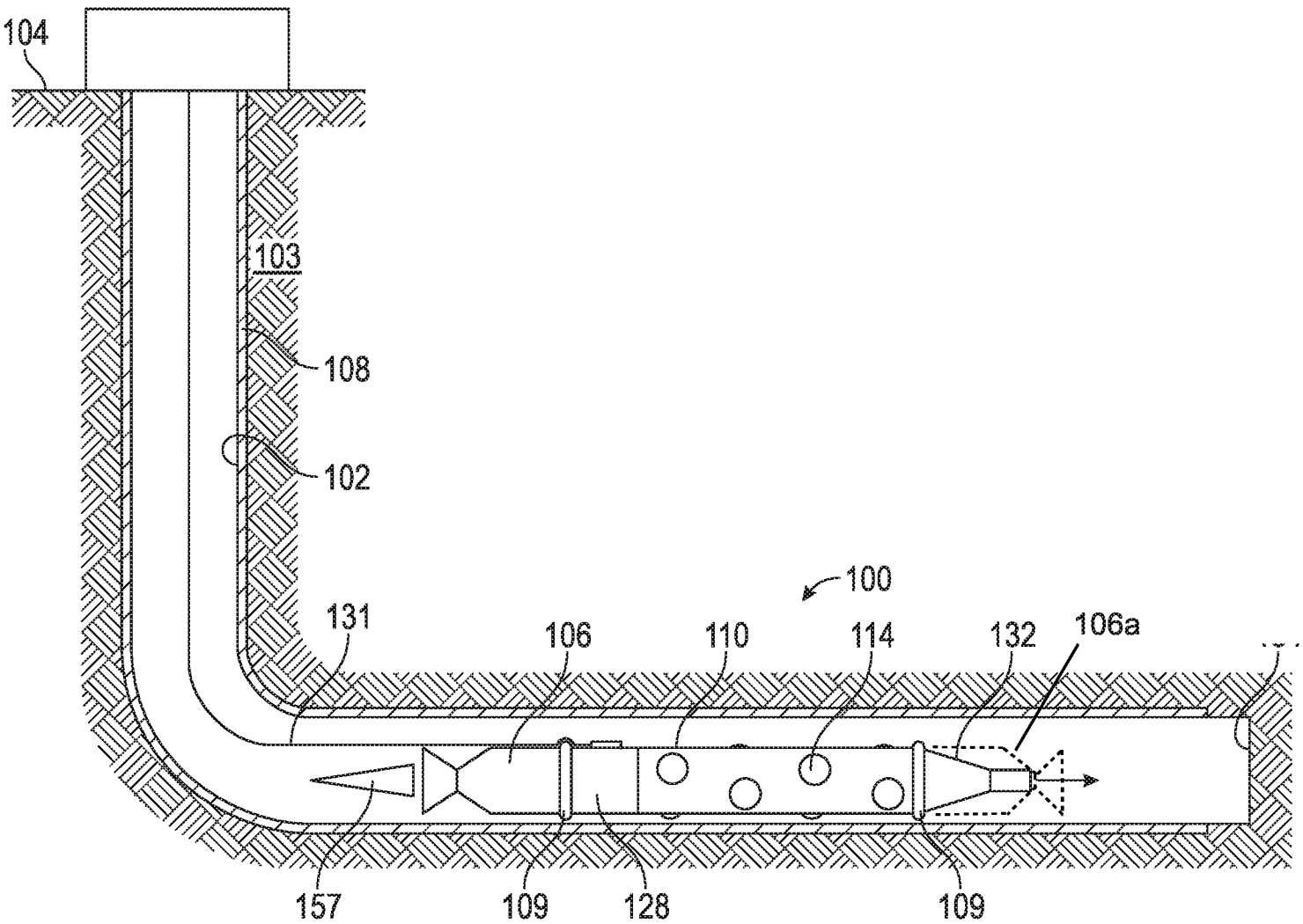
FIG. 4 is a schematic illustration of a perforating gun system in a wellbore in communication with the surface through a communication line, according to one embodiment of the present disclosure.

The detonator 126 in the firing head 128 may be any known detonator that may be activated chemically, mechanically, electrically, or by any other known method to ignite the detonation cord 124. The method used to activate the detonator 126 will generally depend on the design of the detonator 126. In one example, the detonator 126 may be activated electrically by sending an initiation signal from a control unit located at the surface 104 to the detonator 126. For example, as shown in FIG. 4, a control line, tether cable, or other communication link known in the art ("collectively "communication line") 131 extending from the surface 104 and in communication with the detonator 126 (in FIG. 3) may be used to send the initiation signal. In other example embodiments, the detonator 126 may be actuated wirelessly via a wireless signal generated from the surface 104 or from a downhole tool capable of generating a wireless signal.

It should be understood that in embodiments that use a communication line 131 to send the trigger signal to the detonator 126, the communication line 131 does not propel the perforating gun system 100 through the wellbore. Rather, the perforating gun system 100 is self-propelled by the propulsion head 106.

In general, the perforating gun system 100 of the present disclosure remains in the wellbore after activation. However, in some embodiments, a tether cable (such as the communication line 131 shown in FIG. 4) may be used to retrieve the perforating gun system 100 after its activation. In alternate embodiments, an opposing propulsion head **106*a* (shown by the dashed lines in FIG. 4) may be affixed to the nose 132 of the perforating gun system 100 and pointed in an up-hole direction to enable the gun to be propelled back to surface in a controlled manner. In such embodiments, the tether 131 may be combined with the opposing propulsion head 106*a* and the opposing propulsion head 106*a* assists or initiates recovery through use of the tether 131**.

In alternate embodiments having an opposing propulsion head **106*a*, activation of the opposing propulsion head 106*a* may assist with the placement of the perforating gun system 100. For example, to slow the rate of travel of the perforating gun system 100 to assist with the proper location of the perforations, the opposing propulsion head 106*a* may be activated to oppose the force of the propulsion head 106. The propulsion force of the opposing propulsion head 106*a* may be less than or in shorter duration than the propulsion force of the propulsion head 106 to ensure that the perforating gun system 100 does not reverse, but rather slows to a controlled rate of travel. The opposing propulsion head 106*a* may be necessary to ensure that the shaped charges 114 have time to fire in the instance of a perforating gun system 100** travelling at a high rate of speed.

Figure 5:
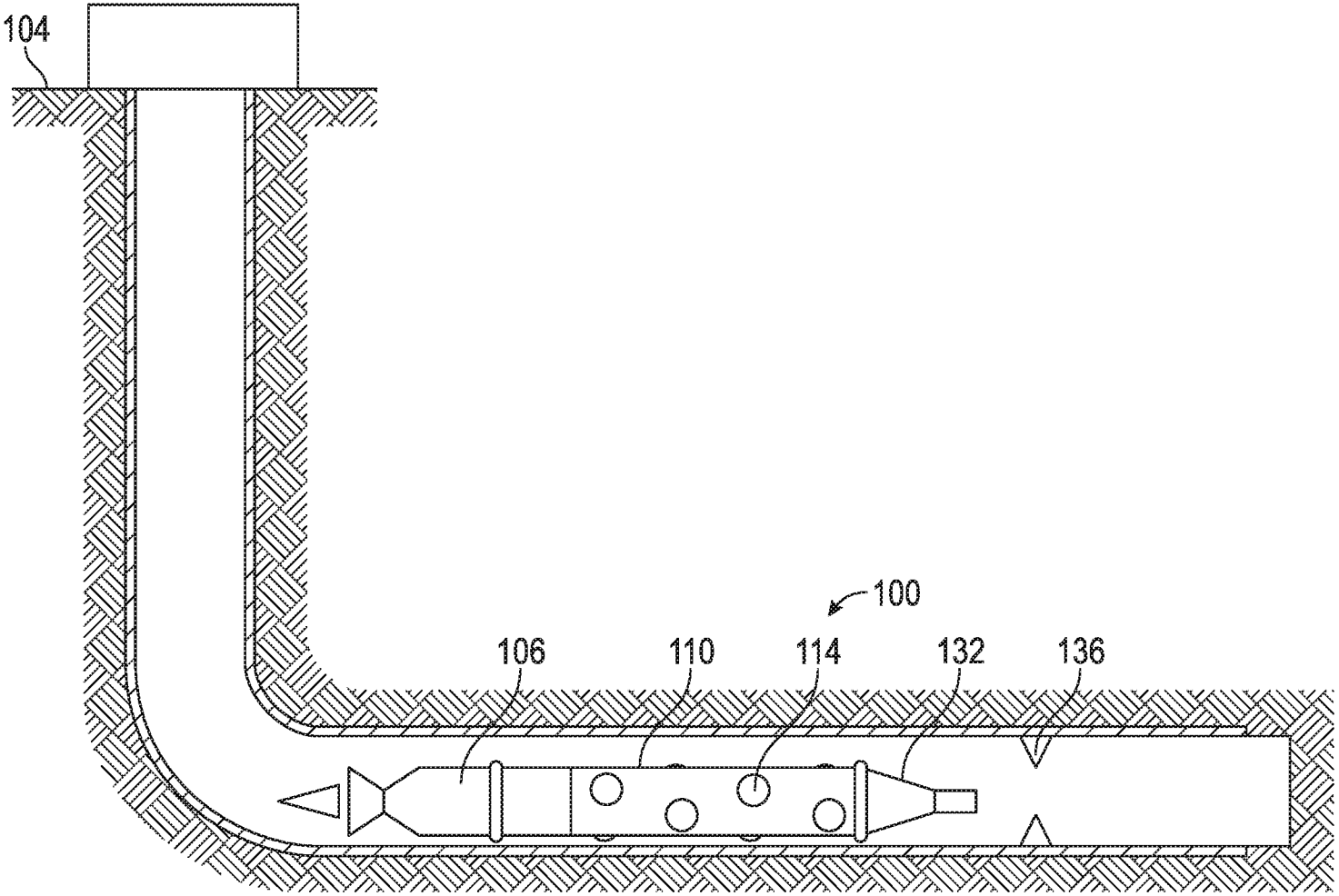
FIG. 5 is a schematic illustration of a perforating gun system in a wellbore with a target locating internal feature, according to one embodiment of the present disclosure.

In another example of the present disclosure, illustrated in FIG. 5, the detonator 126 may be activated when the perforating gun system 100 hits a predetermined internal feature or restriction (136 in FIG. 5), such as a shoulder, in the wellbore 102. In embodiments of the present disclosure, the internal feature 136 may additionally act as a stop for the perforating gun system 100 or may act to initiate a breaking feature such as activation of an anchor or an opposing propulsion head.

In other embodiments of the present disclosure, activation of the detonator 126 may depend on environmental conditions within the wellbore 102. For example, when a pressure sensor carried by the well perforating system 100 senses a predetermined pressure within the wellbore 102 (that can be correlated to a specific depth in the wellbore), the pressure sensor may send a signal to the firing head 128 to activate the detonator 126.

Figure 6:
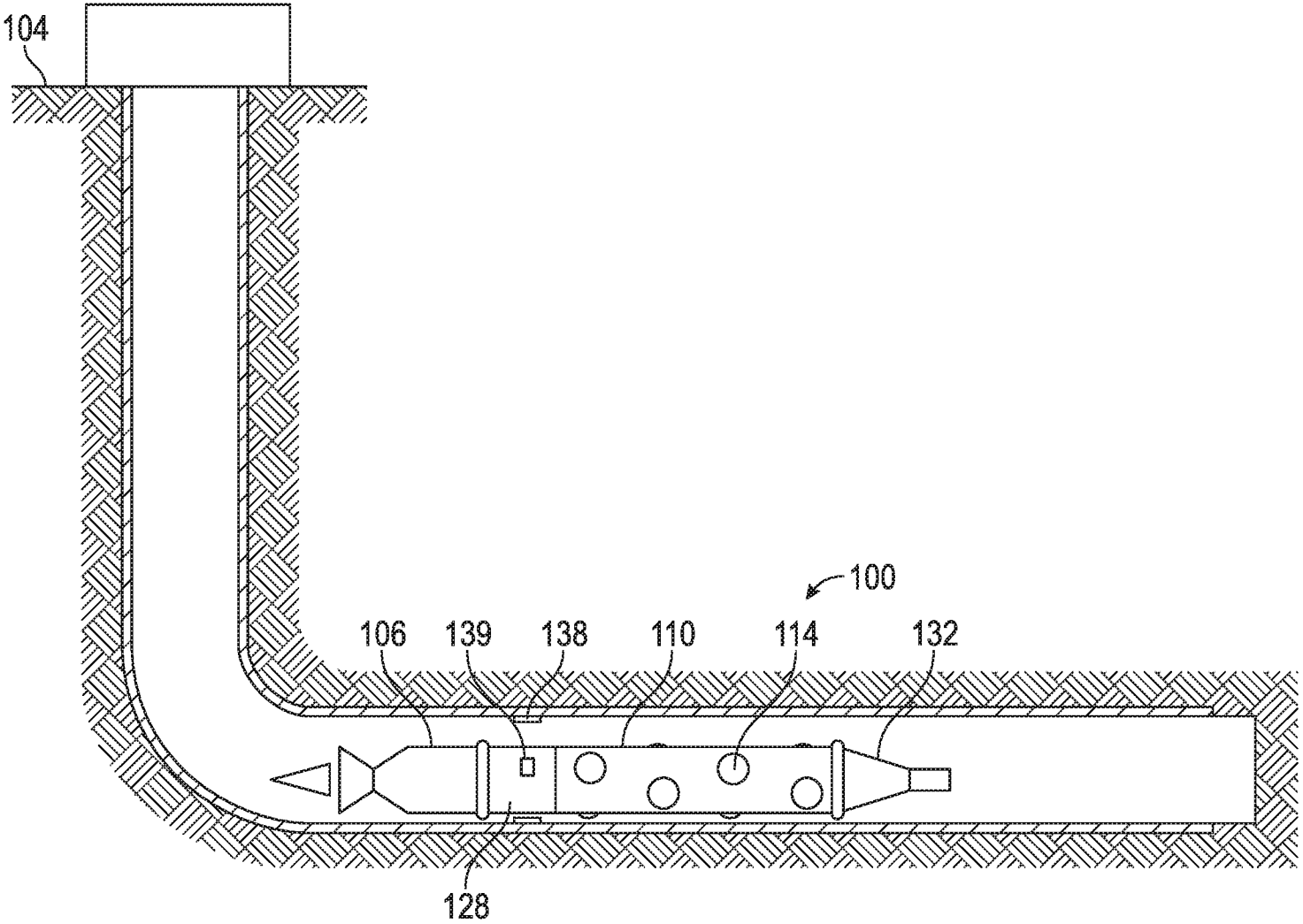
FIG. 6 is a schematic illustration of a perforating gun system in a wellbore with RFID tags and RFID readers identifying the target location for perforation, according to one embodiment of the present disclosure.

In another example, illustrated in FIG. 6, the casing 108 in the wellbore 102 may include RFID tag(s) ("RFID Tag)")138, and the firing head 128 may include an RFID tag reader ("RFID Reader") 139, wherein the detonator 126 is activated when the RFID Reader 139 detects a particular RFID Tag 138 in the wellbore 102. Alternatively, the RFID Reader 139 may be located at a target location in the wellbore 102, and the firing head 128 may include an RFID Tag 138 such that when the RFID Reader 139 detects the RFID Tag 138 in the firing head 128, a signal is sent to the firing head 128 that activates the detonator 126. In embodiments having multiple perforating guns 105, there may be multiple RFID Tags 138 and RFID Readers 139. The RFID Tags 138 and the RFID Readers may be encoded such that they are specific to each individual perforating gun 105 such that activation only occurs when the specific gun passes through the matched RFID Reader 139.

In some embodiments of the present disclosure, the RFID Tags 138 and RFID Readers 139 (collectively the "RFID System") may be additionally used to control the rate of travel. For instance, when the perforating gun system 100 passes a particular location, the RFID System may activate a breaking system such as deploying spring actuated arms or other mechanical anchoring devices (not shown) from the perforating gun system 100 that engage the wellbore 102 to slow the rate of travel of the gun system 100 or to stop the travel of the gun system 100 altogether. Alternatively, in embodiments of the present disclosure having an opposing propulsion head 106*a* such as shown in FIG. 4, the RFID System may actuate the opposing propulsion head 106*a* to slow the rate of travel of the perforating gun system 100.

The self-propelled perforating gun system 100 of the present disclosure may be used in any well to perform a perforation, stimulation, or other operation in the well. For instance, the perforating gun system 100 of the present disclosure may be used in a horizontal well that is to be completed in multiple stages and fractured using the pump down perforating method. In this multistage application, the gun perforating system 100 is used to perforate the wellbore 102 at the lower or bottom end 134 of the well to initiate the pumping of fluid into the well and thus deploy subsequent wireline gun systems.

Figure 7:
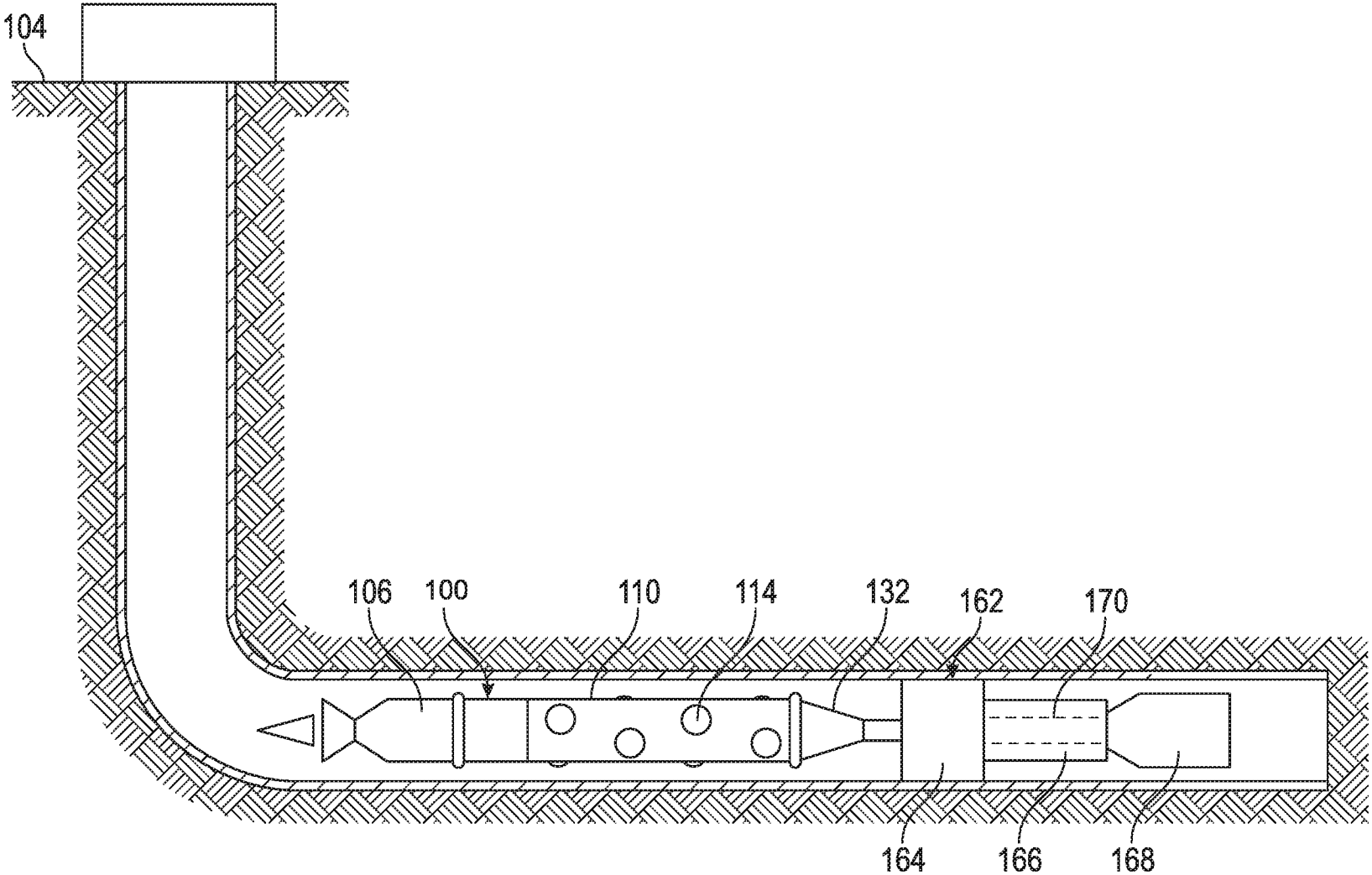
FIG. 7 is a schematic illustration of a perforating gun system extended to include a secondary tool for performing a secondary operation in a wellbore, according to one embodiment of the present disclosure.

In some embodiments, of the present disclosure, the self-propelled perforating gun system 100 may be extended to perform other operations besides perforating a wellbore. For example, FIG. 7 shows an embodiment of the perforating gun system 100 that may enable a stimulation operation in addition to a perforating operation. In FIG. 7, an expander tool 162 has been added to the perforating gun system 100. The expander tool 162 may be as described in U.S. Pat. No. 9,033,041 (Baihly), the disclosure of which is incorporated herein by reference, or may be other type of expander tool to install a seat assembly in a well. In one example, the expander tool 162 includes an anchor 164, such as a hydraulically set anchor, to temporarily anchor the tool 100 in place in the wellbore. The expander tool 162 further includes a seat assembly 166 and a tapered expander 168.

When the system 100 is deployed into the well, the seat assembly 166 is disposed between the anchor 164 and the tapered expander 168. An operator mandrel 170 extends through the seat assembly 166 such that when the expander tool 162 operates to set the seat assembly 166, the tool 100 retracts the mandrel 170 to pull the expander 168 through the interior of the seat assembly 166, which forces the seat assembly 166 to radially expand. The perforating gun system 100 may be used to perforate the casing (or other tubular string in the well) prior to or after installing the seat assembly 166.

As described above, in embodiments of the perforating gun system 100 of the present disclosure, the perforating gun system 100 may be dropped or abandoned in the well 102 after actuation, or in other embodiments the perforating gun system 100 may be retrieved by a tether or other fishing tool. In yet other embodiments of the present disclosure, the perforating gun system 100 may be made of structures and/or materials that disintegrate such that the perforating gun system 100 essentially disappears after perforating the casing/well. A disappearing perforating gun system is described in, for example, U.S. Pat. No. 9,695,677, and the principles disclosed in this patent may be used in constructing the perforating gun system 100 of the present disclosure.

Figure 8:
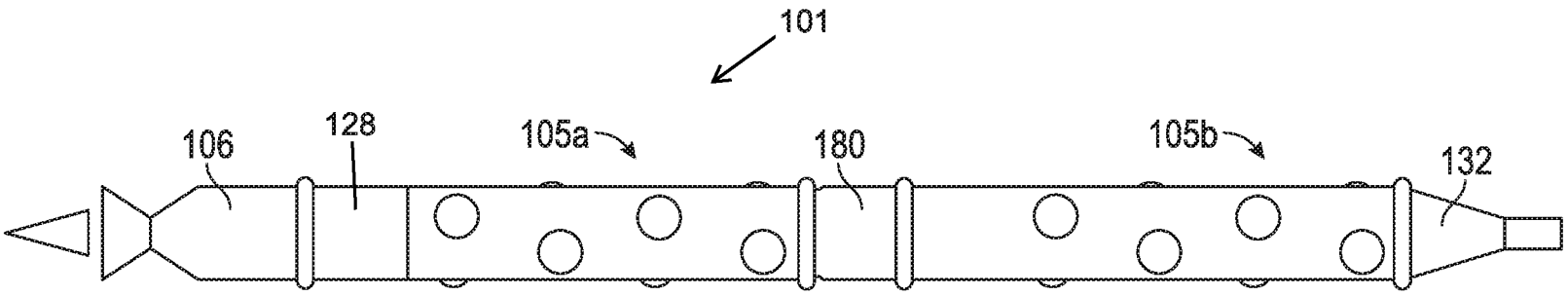
FIG. 8 is a schematic illustration of a perforating gun system having multiple perforating guns, according to one embodiment of the present disclosure.

FIG. 8 illustrates a multiple gun system 101 of the present disclosure. In this embodiment, multiple perforating guns 105*a*, 105*b*, are connected and propelled by the propulsion head 106. As shown, the perforating guns 105*a*, 105*b* are connected through use of an adapter 180. It should be understood that any of the propulsion and actuation systems and methods described herein are applicable to the multiple gun system 101. Additionally, although illustrated with a single firing head 128, the multiple gun system 101 may have multiple firing heads 128 and/or multiple detonators 126 that enable independent actuation of the perforating guns 105*a*, 105*b*. This would enable, for example, the target zones to be perforated or stimulated from toe to heel or heel to toe.

Figure 9A:
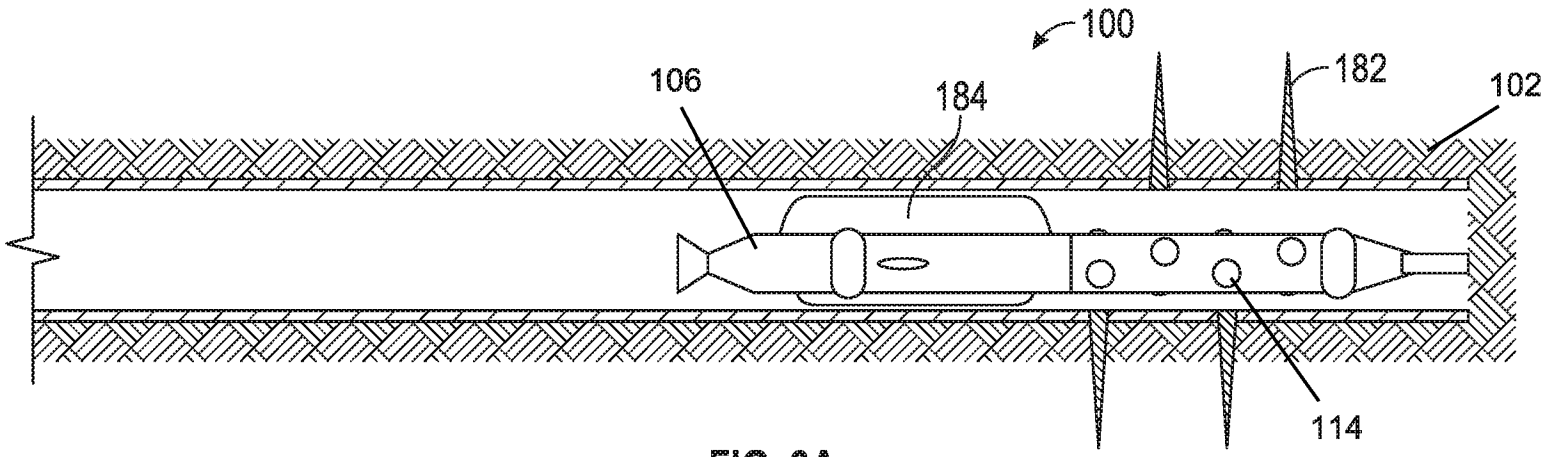
FIG. 9A and FIG. 9B are schematic illustrations of a treatment operation performed in accordance with an embodiment of the present disclosure.
Figure 9B:
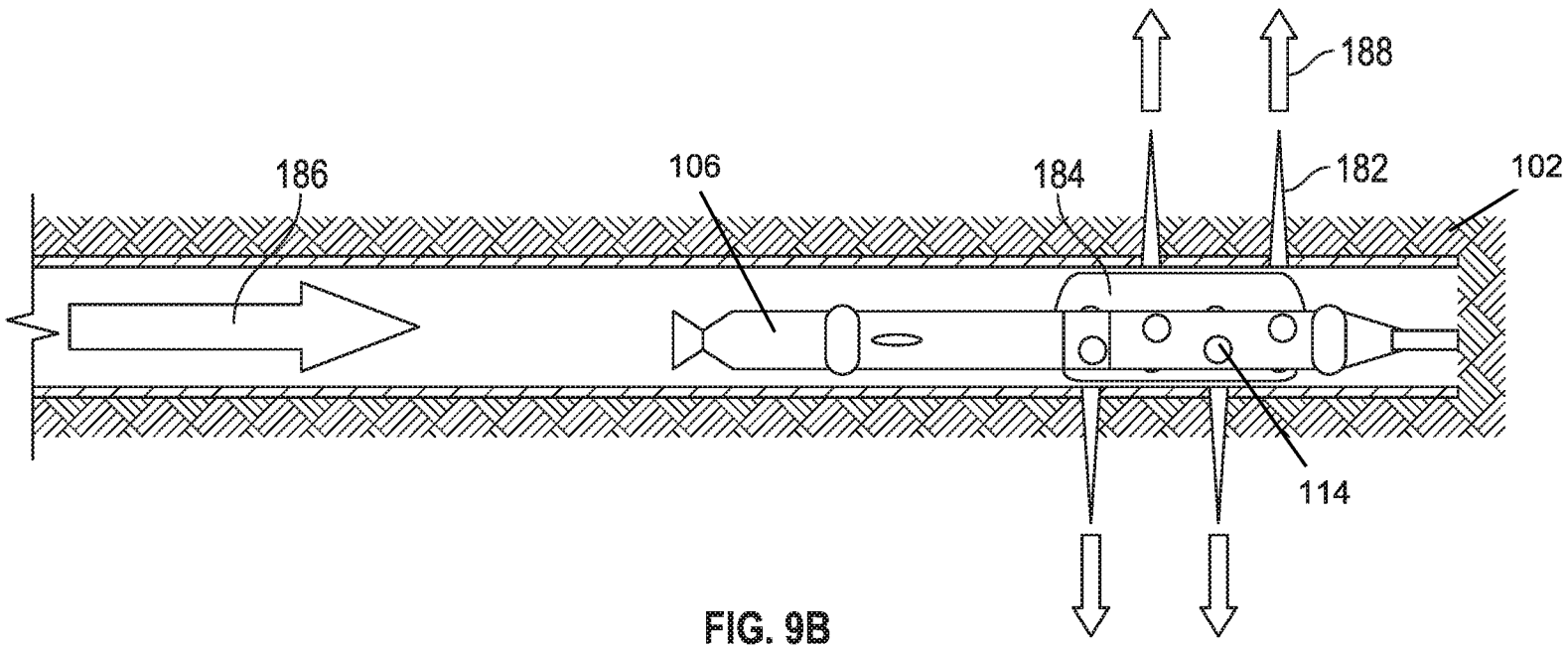

FIG. 9A and FIG. 9B illustrate another stimulation application of the perforating gun system 100 of the present disclosure. As shown in FIG. 9A, the gun system 100 has been propelled into the wellbore by any of the propulsion methods described herein and the shaped charges 114 have been fired to generate the perforations 182 in the wellbore 102. A chemical fluid pill 184, such as an acid pill, is shown approximate the perforating gun system 100. As is known in the art, treatment fluids such as acids are used to enhance the production of reservoir fluids. After perforating the wellbore 102, and as shown in FIG. 9B, the pumping pressure (indicated by arrow 186) from the surface is increased such that the acid pill 184 flows into the perforations 182, as indicated by arrows 188, to acidize the formation. The acid acts to remove near-wellbore formation damage and other damaging substances in order to enhance production by increasing the effective well radius.

Other well systems may be designed as self-propelled systems. That is, a propulsion head 106 may be coupled to other well tools besides a perforating gun to enable the well tools to be self-propelled. Examples of applications where a self-propelled well system may find use include, but are not limited to, a propellant stimulating system, a dumping tool for acid or similar treatment, a cutter or triggered device.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded. In the claims, means-plus-function clauses are intended to cover the structures described herein as performing the recited function and not only structural equivalents, but also equivalent structures. It is the express intention of the applicant not to invoke 35 U.S.C. § 112, paragraph 6 for any limitations of any of the claims herein, except for those in which the claim expressly uses the words "means for" together with an associated function.

The invention claimed is:

1. A perforating gun system for deployment in a wellbore, the wellbore having a bottom end, the perforating gun system comprising:

a perforating gun comprising shaped charges and a detonator actuatable to controllably detonate the shaped charges; and a propulsion head coupled to the perforating gun, the propulsion head operable to apply thrust to the perforating gun, the propulsion head comprising a rocket motor;

wherein the perforating gun system is self-propelling.

2. The perforating gun system of claim 1, wherein the propulsion head comprises propellant.

3. The perforating gun system of claim 1, wherein the detonator is actuated by impact of the perforating gun with the bottom of the wellbore.

4. The perforating gun system of claim 1, further comprising a communication line in communication with the detonator, wherein the communication line sends initiation signals to actuate the detonator.

5. The perforating gun system of claim 1, further comprising an internal feature in the wellbore, wherein the internal feature actuates the detonator when the perforating gun is proximate the internal feature.

6. The perforating gun system of claim 1, further comprising an RFID tag affixed to the perforating gun and further comprising an RFID reader affixed to the wellbore, wherein the detonator is actuated when the RFID tag is proximate the RFID reader.

7. The perforating gun system of claim 1, further comprising a pressure sensor on the perforating gun, wherein the pressure sensor actuates the detonator upon sensing a predetermined wellbore pressure.

8. The perforating gun system of claim 1, further comprising a tether affixed to the perforating gun, wherein the tether is used to retrieve the perforating gun after the shaped charges have been detonated.

9. The perforating gun system of claim 1, wherein the perforating gun disintegrates after detonation of the shaped charges.

10. A perforating gun system for deployment in a wellbore, the wellbore having a bottom end, the perforating gun system comprising:

a perforating gun comprising shaped charges and a detonator actuatable to controllably detonate the shaped charges; and a propulsion head coupled to the perforating gun, the propulsion head operable to apply thrust to the perforating gun;

wherein the perforating gun system is self-propelling, the perforating gun system further comprising an opposing propulsion system affixed to the perforating gun, wherein the opposing propulsion system is to provide a propulsion force opposite the thrust of the propulsion head.

11. A method of perforating, comprising:

propelling a perforating gun comprising shaped charges and a detonator through a wellbore by activation of a propulsion head coupled to the perforating gun, wherein the propulsion head comprises a rocket motor to propel the perforating gun without the aid of external propulsion;

detecting a target location in the wellbore; and in response to detecting the target location in the wellbore, actuating the detonator to detonate the plurality of shaped charges.

12. The method of perforating of claim 11, wherein the propulsion head comprises propellant.

13. The method of perforating of claim 11, further comprising the step of conveying the perforating gun to a target location in the wellbore prior to propelling the perforating gun by activation of the propulsion head.

14. The method of perforating of claim 11, wherein the step of detecting a target location comprises detecting an internal feature in the wellbore.

15. The method of perforating of claim 11, wherein the step of detecting a target location comprises detecting an RFID tag or RFID reader.

16. A method of perforating, comprising:

propelling a perforating gun comprising shaped charges and a detonator through a wellbore by activation of a propulsion head coupled to the perforating gun, wherein the propulsion head propels the perforating gun without the aid of external propulsion;

detecting a target location in the wellbore;

in response to detecting the target location in the wellbore, actuating the detonator to detonate the plurality of shaped charges; and actuating a propulsion system to slow the propelling of the perforating gun through the wellbore.

17. A method of performing a well operation, comprising:

propelling a well tool through a wellbore by activation of a propulsion head coupled to the well tool, wherein the well tool is actuatable to perform a downhole operation, wherein the propulsion head comprises a rocket motor to propel the well tool without the aid of external propulsion;

detecting a target location in the wellbore; and in response to detecting the target location in the wellbore, actuating the well tool to perform the downhole operation.

18. The method of claim 17, wherein the downhole operation is selected from propellant stimulation, acidizing, cement dumping, downhole cutting, or plug and abandonment.

* * * * *